United States Patent [19]

Matsuda et al.

[11] 4,432,321

[45] Feb. 21, 1984

[54] FUEL INJECTION PUMP DEVICE FOR INTERNAL COMBUSTION ENGINE

[75] Inventors: Yasushi Matsuda, Anjo; Shizuo Kawai, Kariya, both of Japan

[73] Assignee: Nippondenso Co., Ltd., Kariya, Japan

[21] Appl. No.: 312,915

[22] Filed: Oct. 19, 1981

[30] Foreign Application Priority Data

Oct. 22, 1980 [JP] Japan ..... 55-151242[U]

[51] Int. Cl.[3] ..... F02D 1/02

[52] U.S. Cl. ..... 123/380

[58] Field of Search ..... 123/380, 382, 383

[56] References Cited

U.S. PATENT DOCUMENTS

| | | | |
|---|---|---|---|
| 2,858,821 | 11/1958 | Isley | 123/382 |
| 3,593,695 | 7/1971 | Kultury et al. | 123/380 |
| 3,651,791 | 3/1972 | Kobayashi | 123/382 |
| 3,736,912 | 6/1973 | Okura et al. | 123/380 |
| 4,227,504 | 10/1980 | Ritter | 123/380 |
| 4,286,559 | 9/1981 | Ritter et al. | 123/380 |
| 4,308,834 | 1/1982 | Ehgim | 123/383 |
| 4,384,560 | 5/1983 | Jager et al. | 123/383 |

FOREIGN PATENT DOCUMENTS

| | | | |
|---|---|---|---|
| 55-37572 | 3/1980 | Japan | 123/380 |

OTHER PUBLICATIONS

Straubel et al., Distributor Injection Pump, 8/1979.

*Primary Examiner*—Ira S. Lazarus
*Assistant Examiner*—Magdalen Moy
*Attorney, Agent, or Firm*—Cushman, Darby & Cushman

[57] ABSTRACT

A fuel injection pump device for an internal combustion engine, in which a mechanical correcting signal continuously generated from a bellows in response to change in atmospheric pressure is transmitted to an adjusting member associated with a pump to adjust an amount of fuel injected into the engine by the pump. Transmission of the mechanical correcting signal from the bellows is limited such that the mechanical correcting signal is allowed to be transmitted to the adjusting member in a range in which the atmospheric pressure is below a predetermined level, but is prevented from being transmitted to the adjusting member when the atmospheric pressure is above the predetermined level.

4 Claims, 7 Drawing Figures

FUEL INJECTION PUMP DEVICE FOR INTERNAL COMBUSTION ENGINE

BACKGROUND OF THE INVENTION

1. Field of the Invention

The present invention relates to a fuel injection pump device for an internal combustion engine, and more particularly to a fuel injection pump device having an altitude compensating unit for controlling an amount of fuel injected into the engine in response to change in altitude or atmospheric pressure.

2. Description of the Prior Art

Air density is gradually decreased with increase in altitude, or as approaching a high land from a level land, and an actual amount of air introduced into the engine is decreased in the high land. If the amount of fuel injected into the engine is maintained constant, the air-fuel ratio will be lowered and smoke will be increased in the high land. A prior art fuel injection pump device is provided with an altitude compensating unit which continuously controls the amount of fuel injected into the engine in response to change in the altitude or atmospheric pressure, to restrain the smoke to a constant level. However, this causes the engine output to be considerably decreased in the high land. In addition, upon adjustment of a pump unit of the fuel injection pump device and upon check or inspection of the engine performance in the level land, the continuous change in the amount of injected fuel in response to the change in atmospheric pressure causes the amount of fuel injected by the pump unit and the engine performance to be changed in accordance with the atmospheric pressure at that time. Accordingly, disadvantages occur that the adjustment is required to be made to the pump unit and the assessment is required to be made to the engine performance with the pressure around the altitude compensating unit adjusted to a predetermined value, or in consideration of the atmospheric pressure.

SUMMARY OF THE INVENTION

An object of the present invention to is to provide a fuel injection pump device for an internal combustion engine, which is capable of reducing the decrease in engine output in the high land and capable of eliminating the disadvantages occuring upon the adjustment of the pump unit and the check of the engine performance.

According to the present invention, there is provided a fuel injection pump device for an internal combustion engine, comprising: an injection pump for forcedly delivering fuel into the engine; means for sensing atmospheric pressure to continuously generate a correcting signal in response to change in the atmospheric pressure; means operative in response to the correcting signal from the sensing means for adjusting the amount of fuel delivered by the pump into the engine so as to increase and decrease the amount of fuel in accordance with increase and decrease in the atmospheric pressure, respectively; and signal-transmission limiting means for limiting the transmission of the correcting signal from the sensing means to the adjusting means such that the correcting signal from the sensing means is allowed to be transmitted to the adjusting means within a first range in which the atmospheric pressure is below a predetermined level, but is prevented from being transmitted to the adjusting means within a second range in which the atmospheric pressure is above the predetermined level.

DESCRIPTION OF THE PREFERRED EMBODIMENTS

Figure 1:
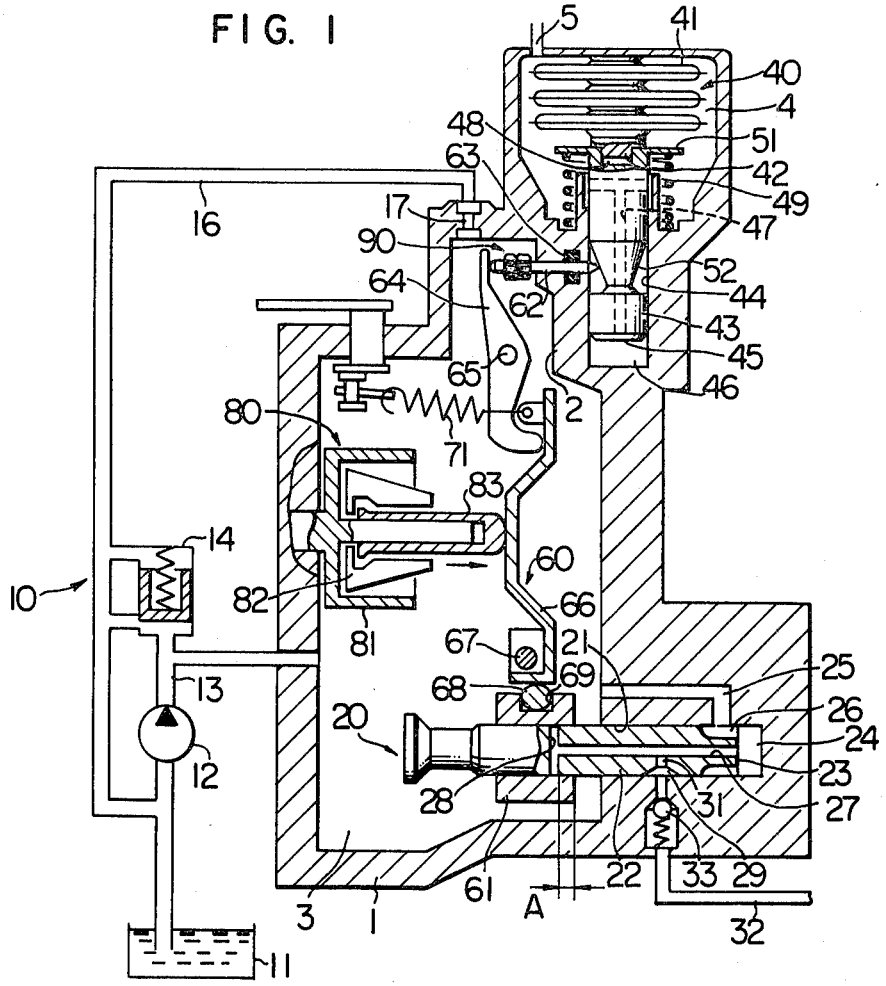
FIG. 1 is a cross-sectional view schematically showing a fuel injection pump device in accordance with the invention.

Referring now to FIG. 1, there is shown in cross-section a fuel injection pump device according to the invention. The fuel injection pump device includes a housing 1 defining therein a space and having a partition wall 2 for dividing the space into a first chamber 3 and a second chamber 4 substantially isolated from the first chamber and communicating with the atmospheric pressure through a conduit 5. Connected to the first chamber 3 is a fuel supply circuit 10 which includes a fuel tank 11, a feed pump 12 for feeding the fuel from the tank 11 into the first chamber 3 through a feed conduit 13 to fill the first chamber with the fuel, a regulating valve 14 for regulating the pressure of the fuel supplied into the first chamber 3 and a return conduit 16 having one end thereof connected to the first chamber 3 through a restriction 17 and the other end connected to the supply conduit 13 downstream of the feed pump 18 for returning a part of the fuel from the first chamber 3 to the supply conduit 13.

The fuel injection pump device further includes an injection pump 20 which is located at the bottom of the housing 1 and which includes a cylinder bore 21 formed in the wall of the housing and a plunger 22 received in the cylinder bore 21 rotatably and axially movably in synchronism with the engine by means of a not shown mechanism. The plunger 22 has axial one end face 23 cooperating with the cylinder bore 21 to define a pump chamber 24 which, when the plunger 22 is in a return stroke or at the bottom dead center, communicates with the first chamber 3 through a supply passage 25 formed in the wall of the housing and a plurality of circumferentially equi-distantly spaced longitudinal grooves 26 formed in a portion of the periphery of the plunger 22 which is located adjacent to the axial one end face 23 of the plunger. The plunger 22 has formed therein an axial bore 27 having one end opening into the axial one end face 23 and a radial bore 28 to which the other end of the axial bore is connected. The radial bore 28 has opposite ends thereof opening into a portion of the periphery of the plunger which is located within the first chamber 3. The plunger 22 has further formed in the periphery thereof a distribution groove 29 communicating with the axial bore 27 through a second radial bore 31 formed in the plunger. A discharge conduit 32 has one end thereof in communication with the distribution groove 29 and the other end in communication with the engine. A check valve 33 is provided in the discharge conduit 32 for preventing the fuel from flowing back into the pump chamber 24. When the plunger 22 is in the return stroke or at the bottom dead center, the supply passage 25 is in alignment with one of the longitudinal grooves 26, and the liquid fuel is supplied from the first chamber 3 into the pump chamber 24 through the supply passage 25 and the longitudinal grooves 26. When the plunger 22 is rotated at the bottom dead center, the longitudinal groove 26 is out of communication with the supply passage 25, and the compression stroke of the plunger 22 is initiated. The fuel within the pump chamber 24 is forcedly delivered into the engine through the axial bore 27, the second radial bore 31, the distribution groove 29 and the discharge conduit 31.

A sensing unit 40 for sensing altitude or atmospheric pressure is disposed within the second chamber 4 and includes a bellows 41 having one end thereof secured to the wall of the housing 1 and the other projecting free end 42. The bellows 41 is expandable and contractible in response to change in atmospheric pressure so that the projecting end 42 of the bellows moves to generate a mechanical correcting signal. A rod 43 is slidably received in a bore 44 formed in the wall of the housing 1 and has axial one end face 45 cooperating with the bore 44 to define a space 46. A passage 47 is formed in the rod 43 to communicate the space 46 with the second chamber 4. The projecting end 42 of the bellows 41 is fitted into a recess 48 formed in the other axial end face of the rod 43 so that the rod moves following the movement of the projecting free end 42 of the bellows 41. A spring 49 is disposed between the wall of the housing 1 and a flange 51 extending radially outwardly from the periphery of the rod 43 adjacent to the other axial end face of the rod. A frustoconical profile surface 52 is formed in a portion of the periphery of the rod 43 between the one and the other axial end faces of the rod. An adjusting unit 60 is provided which is operative in response to the mechanical correcting signal from the bellows 41 of the sensing unit 40 for adjusting the amount of fuel delivered by the pump 20 into the engine so as to increase and decrease the amount of fuel in accordance with increase and decrease in the atmospheric pressure, respectively. The adjusting unit 60 includes a spill sleeve 61 and a linkage mechanism connecting the spill sleeve 61 to the bellows 41 for transmitting the mechanical correcting signal from the bellows through the linkage mechanism for adjusting the amount of liquid fuel delivered by the pump 20 into the engine. The spill sleeve 61 is mounted on the plunger 22 to cover the open ends of the radial bore 28 and slidable along the plunger for adjusting the distance A between an axial one end face of the spill sleeve 61 and the edges of the open ends of the radial bore 28 adjacent to the axial one end face of the spill sleeve 61. The amount of liquid fuel injected into the engine by the pump 20 is determined by the distance A which is adjusted by the position of the spill sleeve 61. More particularly, when the open ends of the radial bore 28 are exposed to the first chamber 3 upon the compression stroke of the plunger 22, the liquid fuel flows into the first chamber 3 from the pump chamber 24 through the axial bore 27 and the radial bore 28, and the supply of the liquid fuel into the engine by the pump 20 is halted or suspended. Thus, the mount of fuel injected into the engine is increased and decreased with increase and decrease in the distance A, respectively.

The linkage mechanism of the adjusting unit 60 includes a slide pin 62 slidably extending through the partition wall 2 and having one end engageable with the profile surface 52 of the rod 43. An O-ring 63 is disposed around the slide pin 62 to substantially prevent the liquid fuel from flowing from the first chamber 3 into the second chamber 4. The linkage mechanism further includes a control lever 64 mounted one a pivot pin 65 secured to the wall of the housing 1 so that the control lever 64 is pivotable within the first chamber 3 around the pivot pin 65. The control lever 65 has one end engageable with the other end of the slide pin 62. A tension lever 66 is pivotally mounted on a pivot pin 67 secured to the wall of the housing 1 and has connected to one end thereof a spherical projection 68 which engages with a recess 69 formed in the periphery of the spill sleeve 61. The other end of the tension lever is engageable with the other end of the control lever 64. A tension spring 71 is disposed between the other end of the tension lever and the wall of the housing 1 to bias the tension lever 66 in the counterclockwise direction in FIG. 1 around the pivot pin 67 so that the control lever 64 is biased in the clockwise direction and the one end of the slide pin 62 is urged against the profile surface 52 of the rod 43.

A centrifugal governor 80 is disposed within the first chamber 3 and includes a weight holder 81 connected to the engine through a not shown mechanism so that the weight holder 81 is rotatable in synchronism with the engine, weights 82 pivotable in response to the rotation of the weight holder 81, and a governor sleeve 83 having its free end engageable with the tension lever 66 for urging the same to angularly move the other end of the tension lever 66 against the tension spring 71 upon the rotation of the weight holder 81. The tension spring 71 has a preload greater than the centrifugal force on the weights 82 at the engine full load under which smoke particularly becomes a problem.

Figure 2:
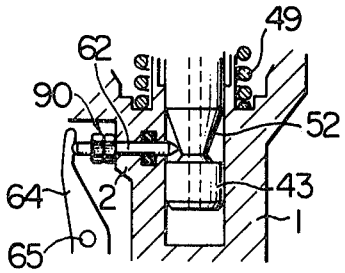
FIG. 2 is a fragmental cross-sectional view of the fuel injection pump device shown in FIG. 1, illustrating a stopper in engagement with a partition wall of a housing.

Signal-transmission limiting means is provided for limiting the transmission of the mechanical correcting signal from the bellows 41 to the spill sleeve 61 such that the correcting signal from the bellows 41 is allowed to be transmitted to the spill sleeve 61 within a first range in which the atmospheric pressure is below a predetermined level, but is prevented from being transmitted to the spill sleeve 61 within a second range in which the atmospheric pressure is above the predetermined level. The signal-transmission limiting means comprises a stopper 90 which is constituted by nuts threadedly engaging with the slide pin 62. As shown in FIG. 2, the stopper 90 engages with the partition wall 2 when the atmospheric pressure reaches the predetermined level and prevents the one end of the slide pin 62 from engaging with the profile surface 52 of the rod 43 when the atmospheric pressure is above the predetermined level.

In the position of the rod 43 shown in FIG. 1, when a vehicle having mounted thereon the fuel injection pump device moves toward a high altitude and the atmospheric pressure around the vehicle is decreased, the bellows 41 is expanded and the projecting end 42 of the bellows moves away from the secured one end thereof. The movement of the projecting free end 42 of the bellows 41 causes the rod 43 to move against the spring 49. At that time, the air within the space 46 is released into the second chamber 4 through the passage 47. The profile surface 52 of the rod 43 which is moving causes the slide pin 62 to move to the left in FIG. 1. The movement of the slide pin 62 to the left causes the control lever 64 to angularly move around the pivot pin 65 in the counterclockwise direction and causes the tension lever 66 to angularly move around the pivot pin 67 in the clockwise direction against the tension spring 71 so that the spill sleeve 61 moves to the left to decrease the distance A and the amount of fuel injected into the engine by the pump 20 is decreased to prevent the smoke from being increased.

When the vehicle moves toward a low altitude and the atmospheric pressure around the vehicle is increased, the bellows 41 is contracted and the projecting free end 42 of the bellows moves toward the secured one end thereof. The movement of the projecting free end 42 of the bellows 41 allows the rod 43 to move under the action of the spring 49 and the profile surface 52 allows the slide pin 62 to move to the right in FIG. 1. The movement of the slide pin 62 to the right causes the control lever to angularly move in the clockwise direction and causes the tension lever 66 to angularly move in the counterclockwise direction under the action of the tension spring 71 so that the spill sleeve 61 is moved to the left to increase the distance A and the amount of fuel injected into the engine by the pump 20 is increased.

Figure 3:
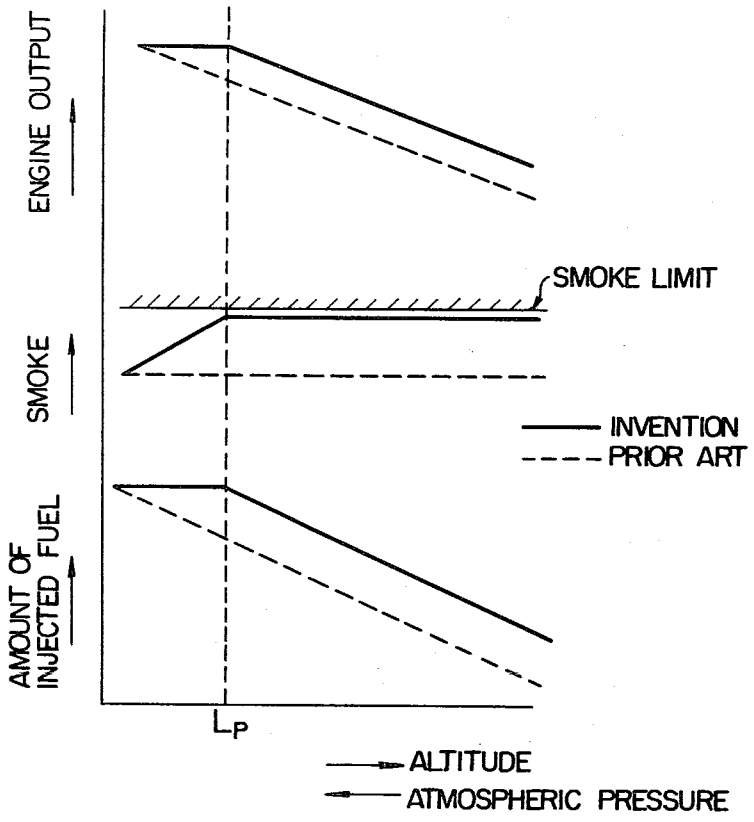
FIG. 3 is a graph showing the relation between altitude or atmospheric pressure and engine output, smoke and amount of injected fuel.

When the altitude where the vehicle is positioned is lowered and reaches a predetermined level, or when the atmospheric pressure around the vehicle is increased and reaches to a predetermined level Lp shown in FIG. 3 corresponding to the predetermined altitude, the stopper 90 engages with the partition wall 2 as shown in FIG. 2, to prevent the slide pin 62 from further moving to the right in FIG. 1, so that the slide pin 62 cannot follow the further movement of the rod 43 toward the secured one end of the bellows 41. Thus, when the atmospheric pressure is above the predetermined level Lp, the mechanical correcting signal from the bellows 41 is not transmitted to the spill sleeve 61 through the slide pin 62, the control lever 64 and the tension lever 66. Accordingly, the engine and the fuel injection pump device have their operating characteristics indicated by the full lines in FIG. 3. It will be of course to set the predetermined level Lp such that the smoke does not exceed the smoke limit in the high land. In general, the predetermined level Lp may be set to a level corresponding to the altitude of approximately 500 meters. It is to be noted, however, that when the atmospheric pressure is above the predetermined level, the spill sleeve 61 is not influenced by the mechanical correcting signal from the bellows 41, but is influenced by the mechanical signal from the centrifugal governor 80.

The prior art fuel injection pump device which includes an altitude compensating unit for continuously controlling the amount of fuel injected into the engine in response to change in altitude or atmospheric pressure to restrain smoke to a constant level indicate characteristics shown by chain lines in FIG. 3. As will be clearly seen from FIG. 3, the engine output is considerably decreased in the high land.

As described above, in the fuel injection pump device according to the present invention, the decrease in engine output can be reduced in the high land or within an area where the atmospheric pressure is low while restraining the smoke within the limit value, and characteristics further approximating to ideal ones can be obtained. In addition, since there are no change in characteristics due to the operation of the sensing unit 40 in a level land where most of factorys manufacturing pumps and vehicles are located, the adjustment of the pumps and the check or inspection of the engine are made easy.

Figure 4:
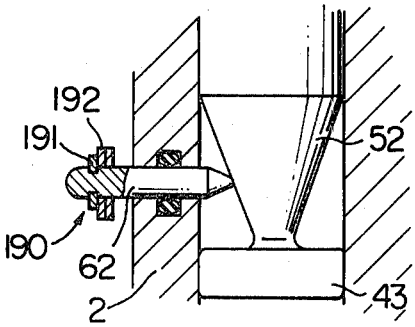
FIG. 4 is a fragmental cross-sectional view showing a modification of the embodiment shown in FIG. 1.

In the embodiment illustrated in FIGS. 1 and 2, the stopper 90 comprises nuts. However, as shown in FIG. 4, a stopper 190 corresponding to the stopper 90 may comprises a snup ring 191 fitted into a circumferential groove in the slide pin 62 and adjusting shims 192 disposed around the slide pin 62 between the snup ring 191 and the partition wall 2. The modification shown in FIG. 4 is advantageous in that the stopper 190 is easy in manufacture and a space occupied by the stopper is decreased.

Figure 5:
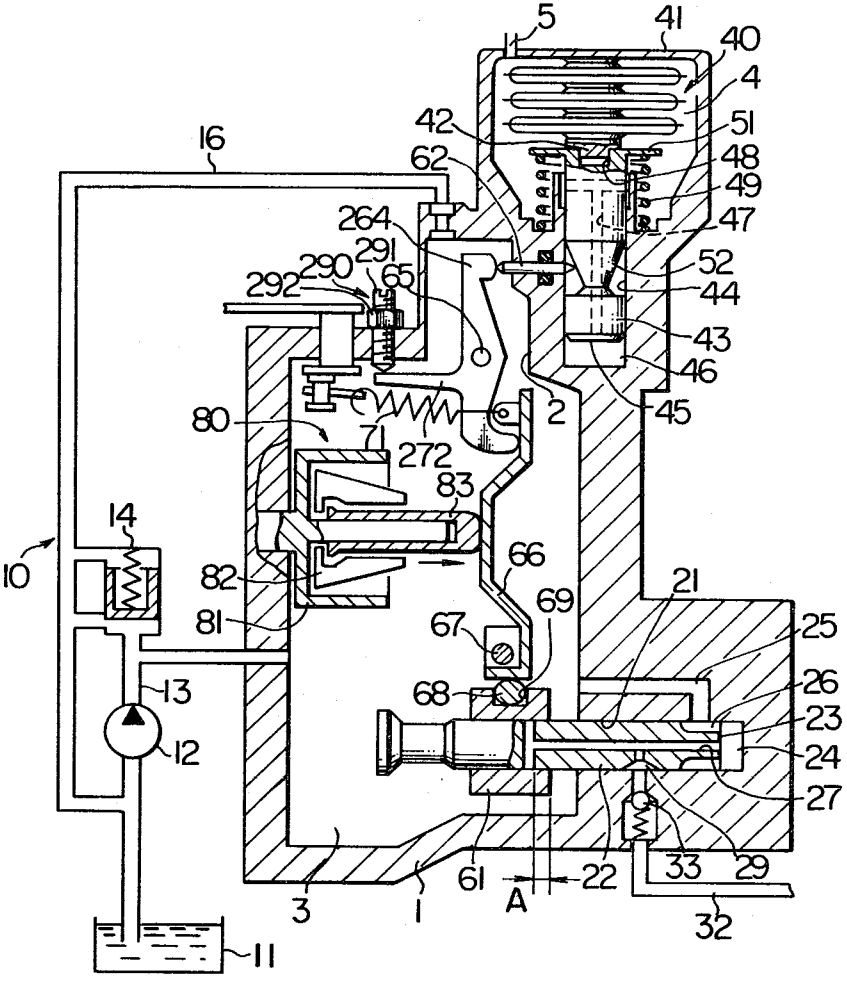
FIG. 5 is a cross-sectional view similar to FIG. 1, but showing another embodiment of the invention.

FIG. 5 illustrates an another embodiment of the present invention, in which elements or parts similar to those shown in FIG. 1 are indicated by the same reference characters, and a description with reference to an operation identical with that in the FIG. 1 embodiment will be omitted.

The embodiment shown in FIG. 5 is substantially identical in structure and function with the embodiment shown in FIG. 1 except that a stopper 290 corresponding to the stopper 90 in FIG. 1 comprises a screw 291 extending through and threadedly engaging with the wall of the housing 1, and a nut 292 engaging with the screw 291. The screw 291 has one end thereof engageable with a projection 272 on a control lever 264 corresponding to the control lever 64 in FIG. 1. The one end of the screw 291 engages with the projection 272 when the atmospheric pressure reaches the predetermined level Lp shown in FIG. 3 and prevents the slide pin 62 from further moving following the movement of the rod 43 toward the secured end of the bellows 41 when the atmospheric pressure is above the predetermined level Lp so that the mechanical correcting signal from the bellows in not transmitted to the spill sleeve 61.

Figure 6:
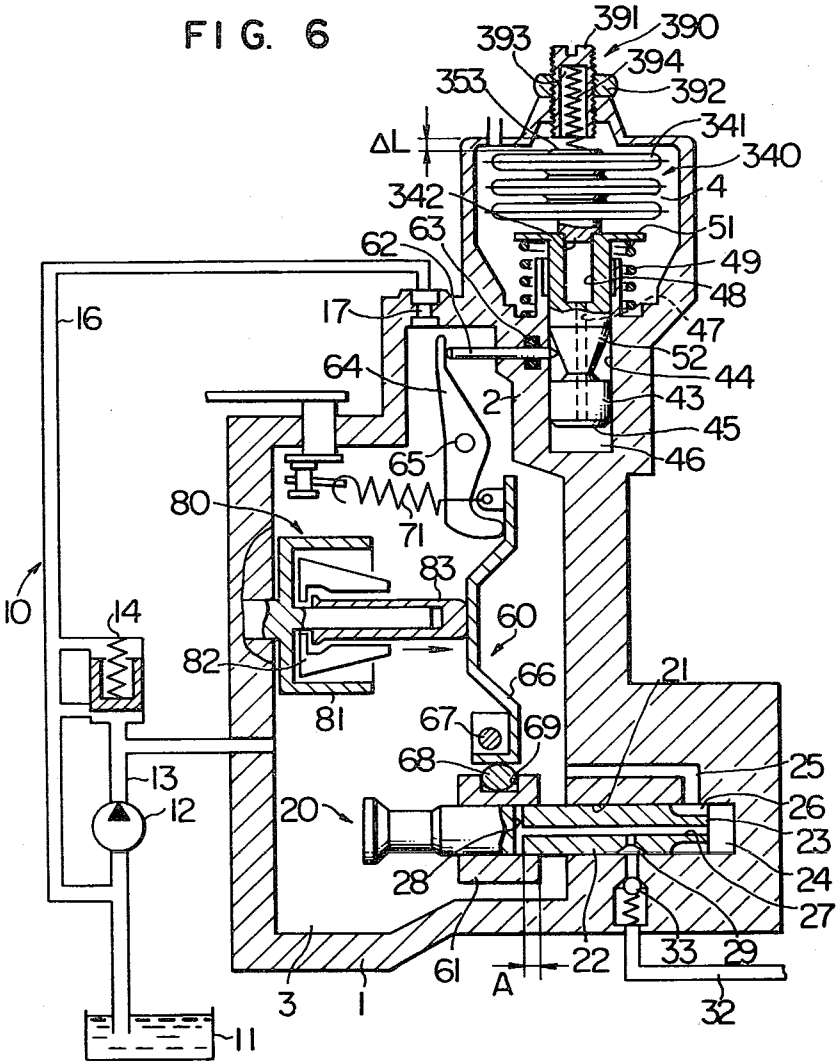
FIG. 6 is a cross-sectional view similar to FIG. 1, but showing a still another embodiment of the invention.

FIG. 6 illustrates a still another embodiment of the present invention, in which elements or parts similar to those shown in FIG. 1 are indicated by the same reference characters, and a description with reference to an operation identical with that in the FIG. 1 embodiment will be omitted.

In the embodiment shown in FIG. 6, a bellows 341 of a sensing unit 341 corresponding to the bellows 41 in FIG. 1 has one free projecting end 342 and the other free end 353, and the spring 49 floatingly supports an assembly of the bellows 341 and the rod 43.

A predetermined gap $\Delta L$ associated with the other free end 353 of the bellows and a stopper 390 cooperating with the other free end 353 of the bellows 341 to define the predetermined gap $\Delta L$ constitute signal-transmission limiting means for limiting the transmission of the mechanical correcting signal from the bellows 341 to the spill sleeve 61 such that the mechanical correcting signal from the bellows 341 is allowed to be transmitted to the spill sleeve 61 within a first range in which the atmospheric pressure is below the predetermined level Lp shown in FIG. 3, but is prevented from being transmitted to the spill sleeve 61 within a second range in which the atmospheric pressure is above the predetermined level Lp. The stopper 390 comprises a screw 391 threadedly engaging with the wall of the housing 1 and a nut 392 threadedly engaging with the screw 391. The screw 391 has formed therein an axial bore 393. A spring 394 is disposed between the bottom of the bore 393 and the other free end of the bellows 341 to urge the bellows toward the rod 43 for preventing the bellows from being vibrated. The spring 394 has a spring constant so sufficiently lower than that of the spring 49 that substantially no influence is imparted to the function of the bellows 341.

When the atmospheric pressure is above the predetermined level Lp shown in FIG. 3, the other free end 353 of the bellows 341 moves within the predetermined gap ΔL against the spring 394, and the projecting end 342 of the bellows is maintained stationary so that the mechanical correcting signal from the bellows 341 is not transmitted to the spill sleeve 61. When the atmospheric pressure reaches the predetermined level Lp, the other free end 353 of the bellows 341 engages with the screw 391. When the atmospheric pressure is below the predetermined level Lp, the projecting end 342 of the bellows 341 moves to cause the rod 43 to move against the spring 49.

Figure 7:
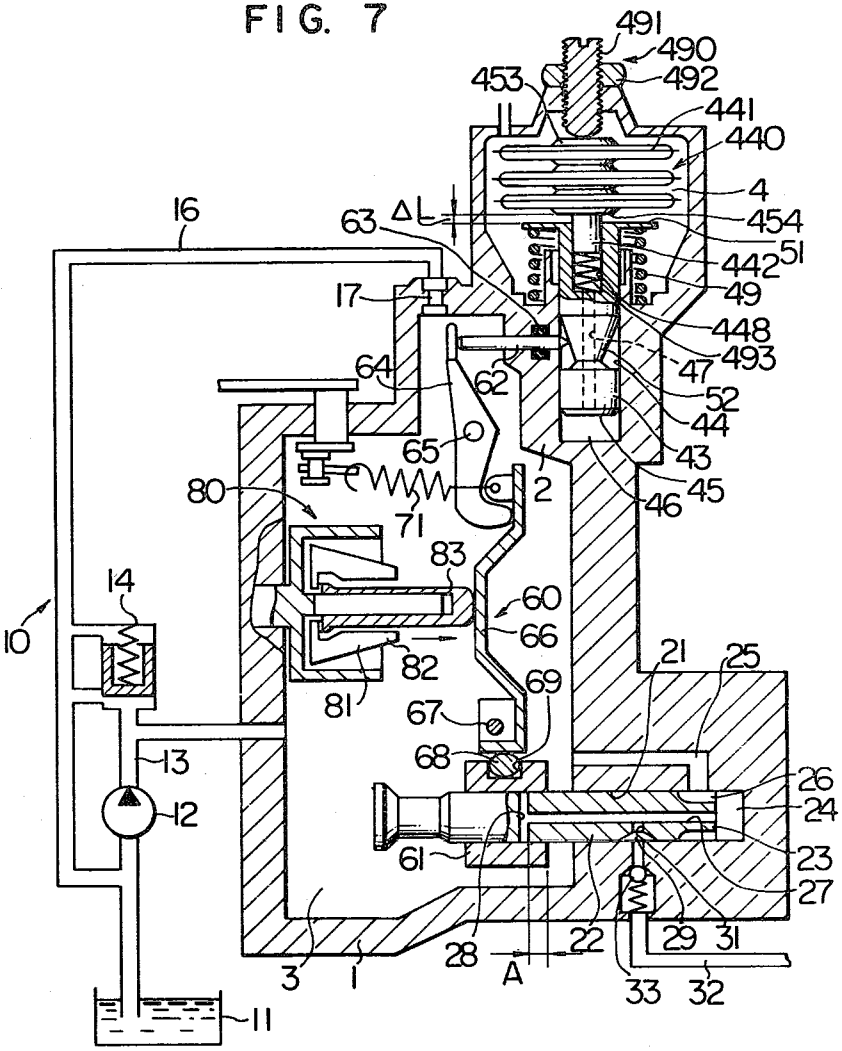
FIG. 7 is a cross-sectional view similar to FIG. 1, but showing a still further embodiment of the invention.

FIG. 7 illustrates a still further embodiment of the invention, in which elements or parts similar to those shown in FIG. 1 are indicated by the same reference characters, and a description with reference to an operation identical with that in the FIG. 1 embodiment will be omitted. In the embodiment shown in FIG. 7, a bellows 441 of a sensing unit 440 corresponding to the bellows 41 in FIG. 1 has one projecting free end 442 and the other free end 453, and the projecting end 442 is connected in a lost-motion manner to the rod 43 such that the projecting end 442 is slidable in a recess 448 in the rod 43.

A predetermined gap ΔL defined between the flange 51 and an end face 454 at the projecting end 442 of the bellows 441 and a stopper 490 engaging with the other free end 453 of the bellows 441 constitute signal-transmission limiting means for limiting the transmission of the mechanical correcting signal from the bellows 441 to the spill sleeve 61 such that the mechanical correcting signal from the bellows 441 is allowed to be transmitted to the spill sleeve 61 within a first range in which the atmospheric pressure is below the predetermined level Lp shown in FIG. 3, but is prevented from being transmitted to the spill sleeve 61 within a second range in which the atmospheric pressure is above the predetermined level Lp. The stopper 490 comprises a screw 491 extending through and threadedly engaging with the wall of the housing 1 and a lock nut 492 threadedly engaging with the screw 491. The spring 49 cooperates with a spring 493 disposed between the projecting free end 442 of the bellows 441 and the bottom of the recess 48 to floatingly support an assembly of the bellows 441 and the rod 43. The spring 493 has a spring constant sufficiently lower that than that of the spring 49.

When the atmospheric pressure is above the predetermined level Lp, the projecting end 442 of the bellows 441 moves within the predetermined gap ΔL against the spring 493 while maintaining the other free end 453 of the bellows in engagement with the screw 491 so that the mechanical correcting signal from the bellows 441 is not transmitted to the spill sleeve 61 through the linkage mechanism comprising the slide pin 62, the control lever 64 and the tension lever 66. When the atmospheric pressure reaches the predetermined level Lp, the end face 454 of the bellows 441 engages with the rod. When the atmospheric pressure is below the predetermined level, the end face 454 of the bellows 441 moves to allow the rod 43 to move against the spring 49.

The present invention has been described with reference to embodiments applied to a distribution type injection pump, but is applicable to a series type injection pump. In such case, is of course to substitute an adjustment of position of a control rack for the adjustment of the position of the spill sleeve 61. In addition, it has been described that the mechanical correcting signal from the bellows 41, 341, 441 is transmitted to the spill sleeve 61 through the slide pin 62, the control lever 64, 264 and the tension lever 66. However, a modification of the bellows, for example, may allow some of such members to be deleted.

What we claim is:

1. A fuel injection pump device for an internal combustion engine, comprising:

an injection pump for forcedly delivering fuel into the engine;

means for sensing atmospheric pressure to continuously generate a mechanical correcting signal in response to change in the atmospheric pressure, said sensing means including a bellows expandable and contractible in response to change in atmospheric pressure in order for at least one end of said bellows to move to generate said correcting signal;

means operative in response to the correcting signal for adjusting the amount of liquid fuel delivered by said pump into the engine so as to increase and decrease the amount of fuel in accordance with the increase and decrease in atmospheric pressure, respectively, said adjusting means including an adjusting member associated with said pump and a linkage mechanism connecting said sensing means to said adjusting member for transmitting the correcting signal through said linkage mechanism for adjusting the amount of fuel delivered by said pump into the engine;

said sensing means further including a rod connected to said one end of said bellows for movement therewith and having a profile surface, said linkage mechanism continuously engaging with said profile surface, and means for floatingly supporting an assembly of said bellows and said rod;

signal-transmission limiting means for limiting the transmission of the correcting signal from said sensing means to said adjusting means such that the correcting signal from said sensing means is allowed to be transmitted to said adjusting means within a first range in which the atmospheric pressure is below a predetermined level, but is prevented from being transmitted to said adjusting means within a second range in which the atmospheric pressure is above said predetermined level, said rod of said sensing means being connected in a lost-motion manner to said one end of said bellows, said signal-transmission limiting means comprising a predetermined gap between said one end of said bellows and rod and a stopper engaging with said the other end of said bellows to maintain said predetermined gap between said one end of said bellows and said rod, the change in the atmospheric pressure within said second range causing said one end of said bellows to move within said predetermined gap, said one end of said bellows engaging with said rod when the atmospheric pressure reaches said predetermined level, and the first change in the atmospheric pressure within said first range causing said rod to move.

2. A fuel injection pump device as defined in claim 1, further including a housing defining therein a space and having a partition wall for dividing said space into a first chamber filled with the liquid fuel and a second chamber substantially isolated from said first chamber for receiving said sensing means, said pump having a pump chamber in communication with said first chamber, said rod of said sensing means having a flange extending radially outwardly from the periphery of said rod, said floatingly supporting means including a first spring disposed between said flange on said rod and a wall of said housing and a second spring disposed between said one end of said bellows and said rod, said first and second springs under their normal condition maintaining said predetermined gap between said one end of said bellows and said flange on said rod.

3. A fuel injection pump device as defined in claim 2, wherein said linkage mechanism includes a slide pin slidably extending through said partition wall and having one end engageable with said profile surface of said rod, a control lever pivotably disposed within said first chamber and having one end engageable with the other end of said slide pin, a tension lever pivotably disposed within said first chamber and having one end connected to said adjusting member and the other end engageable with said the other end of said control lever, and a tension spring urging said the other end of said tension lever in engagement with said the other end of said control lever, said pump including a cylinder bore in the wall of said housing, a plunger slidably received in said cylinder bore to define said pump chamber, a first passage communicating said first chamber with said pump chamber, a second passage formed in said plunger and having one end communicating with said pump chamber and the other end opening into a portion of the periphery of said plunger which is located in said first chamber, and a third passage having one end connected to said pump chamber and the other end communicating with the engine, said adjusting member comprising a spill sleeve mounted on said plunger to cover said the other open end of said second passage and slidable along said plunger for adjusting the distance between one axial end face of said spill sleeve and said the other open end of said second passage.

4. A fuel injection pump device as defined in claim 3, further including a centrifugal governor disposed within said first chamber, said centrifugal governor including a weight holder rotatable in synchronism with the engine, weights pivotable in response to the rotation of said weight holder, and a governor sleeve movable in response to the pivotal movement of said weights, said governor sleeve having its free end engageable with said tension lever for urging the same to angularly move said one end of said tension lever against said tension spring upon the rotation of said weight holder.

* * * * *